US005193975A

United States Patent [19]

Bird et al.

[11] Patent Number: 5,193,975

[45] Date of Patent: Mar. 16, 1993

[54] COOLED GAS TURBINE ENGINE AEROFOIL

[75] Inventors: Jonathan G. Bird, Mickleover; Brian G. Cooper, Repton, both of England

[73] Assignee: Rolls-Royce plc, England

[21] Appl. No.: 650,233

[22] Filed: Feb. 4, 1991

[30] Foreign Application Priority Data

Apr. 11, 1990 [GB] United Kingdom ..... 9008286

[51] Int. Cl.[5] ..... F01D 5/00

[52] U.S. Cl. ..... 415/115; 416/97 R

[58] Field of Search ..... 415/115, 116; 416/96 A, 416/96 R, 97 R

[56] References Cited

U.S. PATENT DOCUMENTS

| | | | |
|---|---|---|---|
| 2,340,417 | 10/1941 | Ellett | 415/914 |
| 3,627,443 | 12/1971 | Pirzer | 415/115 |
| 4,056,332 | 11/1977 | Meloni | 415/115 |
| 4,153,386 | 5/1979 | Leogrande et al. | 415/115 |
| 4,168,938 | 9/1979 | Dodd | 415/115 |

FOREIGN PATENT DOCUMENTS

| | | |
|---|---|---|
| 1525027 | 9/1978 | United Kingdom . |
| 1565361 | 4/1980 | United Kingdom . |
| 2107405 | 4/1983 | United Kingdom . |
| 2119028 | 11/1983 | United Kingdom . |
| 2127105 | 4/1984 | United Kingdom . |

*Primary Examiner*—Edward K. Look
*Assistant Examiner*—Michael S. Lee
*Attorney, Agent, or Firm*—Oliff & Berridge

[57] ABSTRACT

The present invention relates to cooled gas turbine engine aerofoils particularly for turbine stator vanes or tubine rotor blades. The leading edge region of a hollow aerofoil is provided with rows of cooling air passages, which are arranged, in operation, to direct cooling air in the opposite direction to the local flow of the hot gas stream. The cooling air passages are substantially parallel, and have relatively large diameters to reduce the possibility of blockage of the cooling air passages by sand. An air guide tube in the hollow aerofoil is provided with large apertures at its leading edge to minimize the area for sand to adhere to.

7 Claims, 2 Drawing Sheets

COOLED GAS TURBINE ENGINE AEROFOIL

The present invention relates to cooled gas turbine engine aerofoils particularly for turbine stator vanes or turbine rotor blades.

Prior art cooled turbine stator vanes and rotor blades have a plurality of rows of cooling air passages extending through the leading edge region of the aerofoil. These air passages have relatively small diameters and are arranged to provide a cooling film of air on the aerofoil surface.

A problem which arises with this type of cooled gas turbine engine aerofoil, is that debris, ingested by the engine compressor or from compressor linings, abradable coatings or other debris released by the engine upstream of the turbine, which is heated in the combustion chamber, impinges on the leading edge region of the aerofoils in a molten or semi-molten state and sticks to the aerofoils. This eventually causes blockage of the outlets of the cooling air passages, depriving part or the whole of the leading edge regions of the aerofoil of its film cooling and causing the aerofoil to become overheated with a resulting reduction in useful aerofoil life.

Various attempts have been made to overcome this problem including enlarging the diameters of the cooling air passages, but this was not acceptable because of an increased rate of build up of debris.

Our patent GB2127105B discloses an arrangement of aerofoil which reduces the problem of debris blockage of the cooling air passages at the leading edge region of the aerofoil.

The present invention seeks to provide a novel cooled gas turbine engine aerofoil which reduces the blockage of the cooling air passages at the leading edge region of the aerofoil.

Accordingly the present invention provides a cooled gas turbine engine aerofoil comprising a hollow interior arranged to be supplied with cooling air, the aerofoil having a plurality of rows of cooling air passages extending through the leading edge region of the aerofoil to interconnect the hollow interior with an exterior surface of the aerofoil, the aerofoil being located in operation in a hot gas stream, the cooling air passages having axes arranged, in operation, to direct cooling air in the generally opposite direction to the local flow of the gas stream.

Preferably an air guide tube is located in the hollow interior of the aerofoil, the air guide tube has at least one elongate aperture at its leading edge region, the elongate aperture extends longitudinally of the air guide tube.

Preferably the axes of the cooling air passages at the leading edge region of the aerofoil are substantially parallel.

The cooling air passages may have large diameters, for example of 1.06 mm diameter.

The aerofoil may be a turbine stator vane or a turbine rotor blade.

The present invention will be more fully described by way of example with reference to the accompanying drawings, in which.

Figure 1:
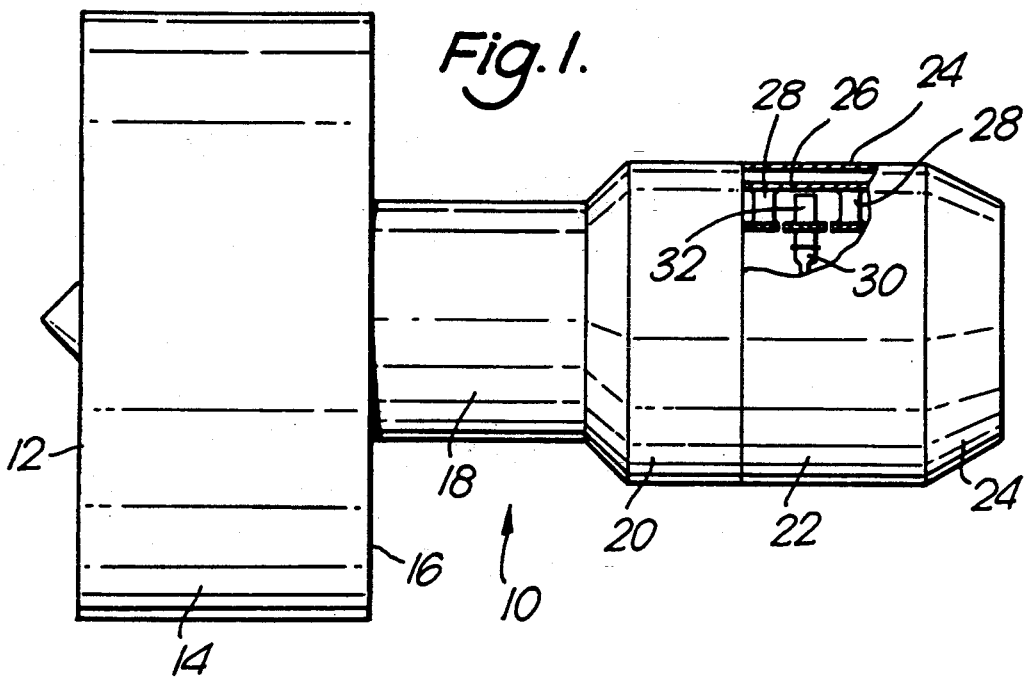
FIG. 1 is a partially cut away view of a turbofan gas turbine engine showing a cooled gas turbine engine aerofoil according to the present invention.

A turbofan gas turbine engine 10 is shown in FIG. 1, and comprises in axial flow series an inlet 12, a fan section 14, a compressor section 18, a combustor section 20, a turbine section 22 and an exhaust nozzle 24. The fan section 14 has a fan exhaust nozzle 16.

The turbofan gas turbine engine 10 operates quite conventionally.

The turbine section 22 comprises an outer casing 24 and an inner casing 26, the inner casing 26 carries a plurality of axially spaced stages of stator vanes 28. Each stage of stator vanes comprises a number of circumferentially arranged radially inwardly extending stator vanes 28. The turbine section 22 also comprises a rotor 30 which carries one or more stages of rotor blades 32. Each stage of rotor blades comprises a number of circumferentially arranged radially outwardly extending rotor blades.

The stator vanes 28 and rotor blades 32 have hollow interiors, to enable cooling air to be supplied into the stator vanes or rotor blades for cooling purposes.

Figure 2:
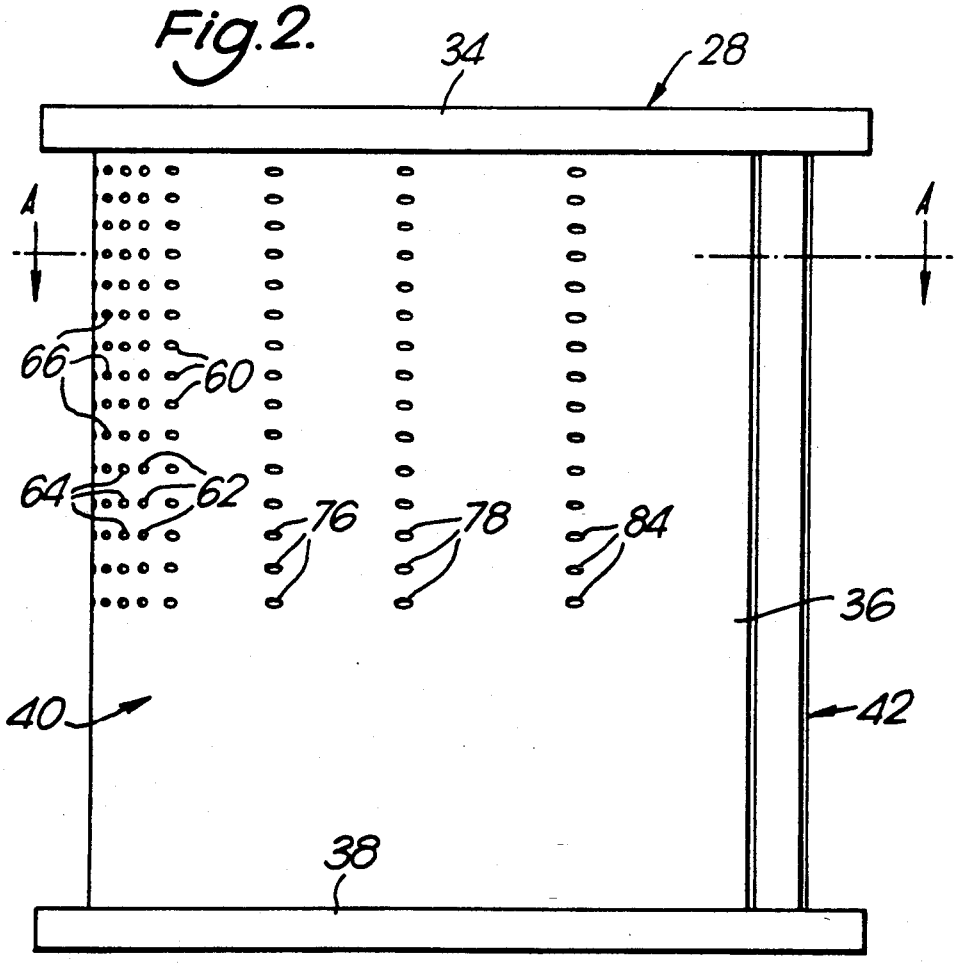
FIG. 2 is an enlarged longitudinal view of a cooled gas turbine engine aerofoil shown in FIG. 1.
Figure 3:
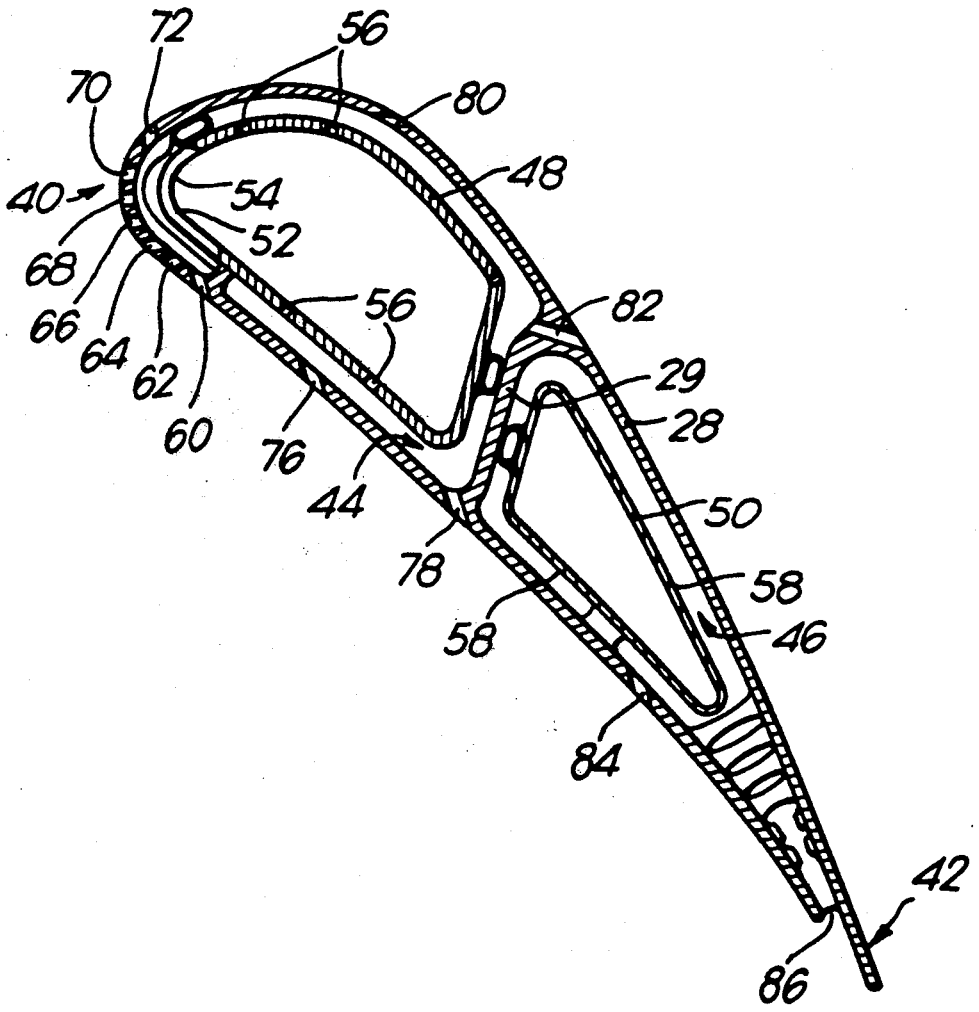
FIG. 3 is a cross-sectional view through the cooled gas turbine engine aerofoil in FIG.2 along line A—A.

A cooled turbine stator vane 28 according to the invention is shown more clearly in FIGS. 2 and 3. The cooled turbine stator vane 28 comprises a radially outer platform 34 and a radially inner platform 38 at opposite ends of an aerofoil portion 36. The aerofoil portion 36 has a leading edge region 40 and a trailing edge region 42. A wall 29 divides the hollow stator vane 28 into a leading edge chamber 44 and a trailing edge chamber 46. A first air guide tube 48 is located in the leading edge chamber 44 of the hollow stator vane 28, and a second air guide tube 50 is located in the trailing edge chamber 46 of the hollow stator vane 28. The first and second air guide tubes 48 and 50 are spaced from the interior surface of the stator vane 28 to define cooling air passages. The first air guide tube 48 is entirely apertured at its leading edge region. Two or more elongate apertures 52 extending longitudinally of the stator vane 28 are provided with one or more thin straps 54 of metal between them. The thin straps 54 may have a corrugated shape, to give the straps resilience and the properties of a spring, to force the free edges of the apertures apart to seal against ribs on the inner surface of the stator vane 28 as disclosed in our UK patent GB2119028B. However it may be possible to provide a single elongate longitudinally extending aperture at the leading edge of the stator vane 28.

The first air guide tube 48 is also provided with a number of other apertures 56.

The second air guide tube 50 is provided with a number of apertures 58.

The aerofoil portion 36 of the stator vane 28 is provided with a plurality of rows of cooling air passages 60,62,64,66,68,70 and 72 which extend through the leading edge region 40 of the aerofoil portion 36. The cooling air passages 62,64,66,68 and 70 are arranged such that their axes are substantially parallel.

In operation cooling air, supplied from the compressor section 18, enters the first air guide tube 48. A first portion of the cooling air flows through the large apertures 52 at the leading edge region of the first air guide tube 48 to the leading edge region 40 of the aerofoil portion 36. The large apertures 52 allow the full cooling air pressure to be fed to the leading edge region 40 of the aerofoil portion 36, where it passes through the rows of cooling air passages 60,62,64,66,68,70 and 72 to cool the leading edge surface.

The cooling air passages 60 and 72 are arranged to direct the cooling air in a generally downstream direction to provide film cooling of the concave, pressure surface and convex, suction surface.

The cooling air passages 62,64,66,68 and 70 are arranged such that in operation, they direct the cooling air in the opposite direction to the local flow of the hot gas stream, this minimises the area of the sidewalls of the cooling air passages available for debris to adhere, and the debris will generally pass through the cooling air passages. The cooling air passages 62,64,66,68 and 70 have relatively large diameters, 1.06 mm compared to the prior art 0.75 mm diameter cooling air passages, this also increases the operational time before any one cooling air passage becomes blocked with debris.

The large apertures 52 allow any debris, which has passed through the cooling air passages 62,64,66,68 and 70, to flow into the first air guide tube 48. Thus the leading edge region of the cooling air guide tube 48 has a very small outer surface area available for debris to impinge upon and adhere to, this reduces or prevents the possibility of the debris adhering on the cooling air guide tube 48 outer surface and blocking the space between the leading edge region of the cooling air guide tube 48 and aerofoil portion 36.

A second portion of the cooling air flows through the apertures 56 in the wall of the air guide tube 48 to impinge on the inner surface of the concave, pressure flank and convex, suction flank of the aerofoil portion 36 to provide impingement cooling. This cooling air then flows in a downstream direction to flow through film cooling apertures 76 and 78 in the concave, pressure flank and film cooling apertures 80 and 82 in the convex, suction flank.

Cooling air is also supplied from the compressor section 18 to the second air guide tube 50. The cooling air flows through the apertures 58 in the wall of the air guide tube 50 to impinge on the inner surface of the concave, pressure flank and convex, suction flank of the aerofoil portion 36 to provide impingement cooling. The cooling air then flows in a downstream direction to flow through film cooling apertures 84 in the concave, pressure flank and to film cooling apertures 86 at the trailing edge 42 of the aerofoil portion 36.

The invention has been described with reference to cooled turbine stator vanes but is also applicable to cooled turbine rotor blades.

The invention is particularly useful in preventing the cooling air passages at the leading edge region of a cooled turbine stator vane or cooled turbine rotor blade becoming blocked by sand particles in sandy or desert environments, by dust or by debris released by the engine.

The diameters of the cooling air passages are increased relative to the prior art cooling air passages to reduce the possibility of blockage. The actual dimension of the increased diameters is dependent upon the size of the particular turbine stator vane or turbine rotor blade.

We claim:

1. A cooled gas turbine engine aerofoil comprising a hollow interior arranged to be supplied with cooling air, the aerofoil having a leading edge region and a trailing edge, the leading edge region having a convex, curved exterior surface, the aerofoil having an exterior surface and a plurality of rows of cooling air passages extending through the leading edge region of the aerofoil to interconnect the hollow interior with the exterior surface of the aerofoil, each of the cooling air passages having an axis and a sidewall, the aerofoil being located in operation in a hot gas stream, the cooling air passages in each of the rows at the leading edge region of the aerofoil and in the adjacent rows at the leading region of the aerofoil being arranged such that their axes are substantially parallel, the cooling air passages having parallel axes arranged in operation to direct cooling air in the generally opposite direction to the local flow of the gas stream to minimize an area of the sidewall onto which debris entering the cooling air passages may adhere.

2. A cooled aerofoil as claimed in claim 1 in which an air guide tube is located in the hollow interior of the aerofoil, the air guide tube has at least one elongate aperture at the leading edge region of the air guide tube, the elongate aperture extends longitudinally of the air guide tube.

3. A cooled aerofoil as claimed in claim 1 in which there are three or more rows of cooling air passages.

4. A cooled aerofoil as claimed in claim 3 in which there are five rows of cooling air passages.

5. A cooled aerofoil as claimed in claim 1 in which the cooling air passages have diameters of 1.06 mm.

6. A cooled aerofoil as claimed in claim 1 in which the aerofoil is a turbine stator vane.

7. A cooled aerofoil as claimed in claim 1 in which the aerofoil is a turbine rotor blade.

* * * * *